US007427709B2

(12) United States Patent
Lee et al.

(10) Patent No.: US 7,427,709 B2
(45) Date of Patent: Sep. 23, 2008

(54) APPARATUS AND METHOD FOR PROCESSING MIDI

(75) Inventors: Jae Hyuck Lee, Seoul (KR); Jung Min Song, Seoul (KR); Yong Chul Park, Seoul (KR); Jun Yup Lee, Yongin-si (KR)

(73) Assignee: LG Electronics Inc., Seoul (KR)

( * ) Notice: Subject to any disclaimer, the term of this patent is extended or adjusted under 35 U.S.C. 154(b) by 460 days.

(21) Appl. No.: 11/085,950

(22) Filed: Mar. 21, 2005

(65) Prior Publication Data

US 2005/0204903 A1 Sep. 22, 2005

(30) Foreign Application Priority Data

Mar. 22, 2004 (KR) ..... 10-2004-0019381

(51) Int. Cl.
*G10H 7/00* (2006.01)

(52) U.S. Cl. ..... 84/645; 84/603; 84/609; 84/622

(58) Field of Classification Search ..... 84/603, 84/622, 609, 645
See application file for complete search history.

(56) References Cited

U.S. PATENT DOCUMENTS 4,336,736 A * 6/1982 Mishima ..... 84/635
5,117,726 A * 6/1992 Lisle et al. ..... 84/608
5,119,711 A * 6/1992 Bell et al. ..... 84/622
5,315,057 A * 5/1994 Land et al. ..... 84/601
5,367,117 A * 11/1994 Kikuchi ..... 84/603
5,367,120 A * 11/1994 Hoshiai ..... 84/654
5,444,818 A * 8/1995 Lisle ..... 704/258
5,451,707 A * 9/1995 Suzuki ..... 84/604
5,471,006 A * 11/1995 Schwartz et al. ..... 84/609
5,734,118 A * 3/1998 Ashour et al. ..... 84/609
5,744,739 A * 4/1998 Jenkins ..... 84/603
5,824,936 A * 10/1998 DuPuis et al. ..... 84/663
5,837,914 A * 11/1998 Schwartz et al. ..... 84/622
5,880,392 A * 3/1999 Wessel et al. ..... 84/659
5,917,917 A * 6/1999 Jenkins et al. ..... 381/63
5,981,860 A * 11/1999 Isozaki et al. ..... 84/603
6,008,446 A * 12/1999 Van Buskirk et al. ..... 84/603

(Continued)

FOREIGN PATENT DOCUMENTS

EP 0600639 A 6/1994

(Continued)

*Primary Examiner*—Lincoln Donovan
*Assistant Examiner*—Christina Russell
(74) *Attorney, Agent, or Firm*—Lee, Hong, Degerman, Kang & Schmadeka

(57) ABSTRACT

Provided are an apparatus and a method for processing MIDI in a wireless terminal capable of controlling a volume of sound source samples when the MIDI is played. According to the method, a plurality of notes, volume levels, volume section information, and note playback duration information are extracted from an inputted MIDI file. After a volume sample number in each section is calculated using the extracted volume level and the volume section information, a volume of the sound source samples that correspond to a note that is to be played is controlled using the volume sample numbers. Next, frequency of the sound source samples are converted to a frequency assigned to the notes and the sound source samples are outputted, reducing a system load caused by the real-time play of the MIDI.

16 Claims, 5 Drawing Sheets

U.S. PATENT DOCUMENTS

| | | | | |
|---|---|---|---|---|
| 6,096,960 | A * | 8/2000 | Scott | 84/603 |
| 6,199,163 | B1 * | 3/2001 | Dumas et al. | 713/183 |
| 6,225,546 | B1 * | 5/2001 | Kraft et al. | 84/609 |
| 6,255,577 | B1 * | 7/2001 | Imai | 84/609 |
| 6,362,411 | B1 * | 3/2002 | Suzuki et al. | 84/626 |
| 6,365,817 | B1 * | 4/2002 | Suzuki et al. | 84/603 |
| 6,392,135 | B1 * | 5/2002 | Kitayama | 84/622 |
| 6,437,227 | B1 * | 8/2002 | Theimer | 84/609 |
| 6,525,256 | B2 * | 2/2003 | Boudet et al. | 84/645 |
| 6,867,356 | B2 * | 3/2005 | Nishimoto | 84/603 |
| 7,126,051 | B2 * | 10/2006 | Fay et al. | 84/609 |
| 7,151,215 | B2 * | 12/2006 | Hsieh | 84/603 |
| 2001/0023634 | A1 * | 9/2001 | Tamura | 84/603 |
| 2001/0045155 | A1 * | 11/2001 | Boudet et al. | 84/645 |
| 2002/0156938 | A1 * | 10/2002 | Wong et al. | 709/328 |
| 2002/0170415 | A1 * | 11/2002 | Hruska et al. | 84/609 |
| 2003/0012367 | A1 * | 1/2003 | Seo | 379/419 |
| 2003/0017808 | A1 * | 1/2003 | Adams | 455/76 |
| 2004/0039924 | A1 * | 2/2004 | Baldwin et al. | 713/189 |
| 2004/0055444 | A1 * | 3/2004 | Ishii et al. | 84/604 |
| 2004/0077342 | A1 * | 4/2004 | Cho | 455/418 |
| 2004/0209629 | A1 * | 10/2004 | Virolainen et al. | 455/466 |
| 2005/0056143 | A1 * | 3/2005 | Fay | 84/645 |
| 2005/0188819 | A1 * | 9/2005 | Lin et al. | 84/603 |
| 2005/0211075 | A1 * | 9/2005 | Desai et al. | 84/645 |
| 2006/0086238 | A1 * | 4/2006 | Lee et al. | 84/645 |
| 2006/0180006 | A1 * | 8/2006 | Kim | 84/609 |
| 2006/0230909 | A1 * | 10/2006 | Song et al. | 84/609 |
| 2007/0063877 | A1 * | 3/2007 | Shmunk et al. | 341/50 |

FOREIGN PATENT DOCUMENTS

| | | | |
|---|---|---|---|
| WO | WO 9811531 | A | 3/1998 |
| WO | WO 9811531 | A1 * | 3/1998 |

* cited by examiner

APPARATUS AND METHOD FOR PROCESSING MIDI

CROSS-REFERENCE TO RELATED APPLICATIONS

Pursuant to 35 U.S.C. § 119(a), this application claims the benefit of earlier filing date and right of priority to Korean Application No. 10-2004-0019381, filed on Mar. 22, 2004, the contents of which are hereby incorporated by reference herein in their entirety.

BACKGROUND OF THE INVENTION

1. Field of the Invention

The present invention relates to an apparatus and a method for processing MIDI data, and more particularly, to an apparatus and a method for processing MIDI data which are capable of outputting rich sound quality with few system resources by controlling a volume of sound sources before converting the sound sources to a frequency.

2. Description of the Related Art

A wireless terminal is an apparatus for performing communication or transmitting/receiving data while moving. For example, the wireless terminal may be a cellular phone or a personal digital assistant (PDA).

Musical instrument digital interface (MIDI) is a standard protocol enabling data communication between electronic musical instruments. The MIDI is a standard specification for hardware and data structure that provide compatibility for the input/output between musical instruments or between musical instruments and computers through digital interface. Accordingly, devices having the MIDI can share data with each other because compatible data are created therein.

A MIDI file contains information such as intensity and tempo of a note, command language related to musical characteristics, and a type of a musical instrument as well as an actual musical score. However, unlike a wave file, a MIDI file does not store waveform information, the file size of the MIDI file is relatively small, and it is easy to edit the MIDI file (for example, adding or deleting an instrument).

In the early days, an artificial sound was produced by using a frequency modulation (FM) method to reproduce a sound of a musical instrument. The FM method has an advantage of using a small amount of memory since no separate sound source is used when reproducing the sound of the musical instrument. However, the FM method has a disadvantage of not being able to reproduce a natural sound close to an original sound.

As the price of memory has fallen, a method has been developed for producing and storing individual sound sources for each musical instrument and each of its notes in a memory, and producing sound by changing frequencies and vibrations while maintaining the instrument's unique waveform. This method uses a wave-table, in which the above-mentioned sound source samples are stored, and is widely used because it is capable of producing a natural sound closer to the original sound.

FIG. 1 is a schematic view illustrating construction of a MIDI player in the related art.

As illustrated in FIG. 1, the MIDI player includes: a MIDI parser 110 for extracting a plurality of notes and note playback duration information from a MIDI file; a MIDI sequencer 120 for sequentially outputting the extracted note playback duration; a wave table 130 for recording at least one sound source sample; an envelope generator 140 for generating an envelope which determines levels of a volume and a pitch; and a frequency converter 150 for applying the envelope to the sound source sample recorded in the wave table according to the note playback duration information, and then outputting the note playback duration by converting the envelope to a frequency assigned to the plurality of notes.

The MIDI file, containing information about certain music, is stored in a storage medium and may include a score such as a plurality of notes, note playback duration information, and timbre. The note is information representing a minimum unit of a sound, and a plurality of notes represents a musical scale. The musical scale provides information about a note's tone (low or high), and seven notes (for example, C, D, E, etc.) are generally used in the musical scale. The note playback duration information provides information about a length of each note. The timbre represents a tone color and includes the note's unique characteristic that distinguishes two notes having the same tone, intensity, and length. For example, a 'C' note of the piano may be distinguished from a 'C' note of the violin according to their difference in characteristic timbres.

Further, the note playback duration means a length of playback time for each of the notes included in the MIDI file, and contains information about the note's playback length. For example, if a playback duration of a note 'D' is ⅛ second, the note 'D' from a sound source is played for ⅛ second.

Sound sources for each instrument and each note of the individual instruments are recorded in the wave table 130. Although, the scale is normally in a range of 1 through 128, there are limitations in recording all sound sources for all of the notes in the wave table 130. Accordingly, only a number of sound source samples are recorded for representative several notes in the wave table 130.

The envelope generator 140 generates an envelope which determines levels of a volume and a pitch according to envelope information preset by a user or in the MIDI file, and controls the volume or the pitch of the sound source samples played in response to the notes included in the MIDI file. Therefore, the envelope has a great influence on quality of the sound source sample played, and may use considerable resources of a central processing unit (CPU).

The envelope may be an envelope for volume or an envelope for pitch. The envelope for volume may be classified into four sections including an attack, a decay, a sustain, and a release.

Since those four sections for the sound source's volume are included in volume section information, they are used in synthesizing a sound.

The frequency converter 150 reads a sound source sample for each note from the wave table 130 if a playback duration for a note is inputted, applies an envelope generated from the envelope generator 140 to the read sound source sample, and outputs the sound source sample by converting the envelope to a frequency assigned to the note. An oscillator may be used as a frequency converter 150.

For example, if the sound source sample recorded in the wave table 130 was sampled with 20 KHz and a note of music is sampled with 40 KHz, the frequency converter 150 converts the 20 KHz sound source sample into a 40 KHz sound source sample to output the 40 KHz sound source sample.

Further, if the sound source sample for each note is not recorded in the wave table 130, a representative sound source sample for each note is read from the wave table 130, and the frequency of the read sound source sample is converted into a frequency of a sound source sample that corresponds to each note. If a sound source sample for a certain note is recorded in the wave table 130, the corresponding sound source sample can be read and outputted from the wave table 130 without any frequency conversion.

The above-described process is performed repeatedly whenever the note playback duration information for each note is inputted until the playback of the MIDI is terminated.

However, the conventional MIDI player sequentially applies the envelope to the sound source sample and converts the envelope to the frequency that corresponds to each note. Accordingly, a system requires a considerable amount of operations and consumes considerable CPU resources. Further, the MIDI file should be played and outputted in real time. However, since the frequency conversion is performed for each note as described above, music might not be played in real time.

Consequently, since the conventional MIDI player consumes considerable CPU resources, it is difficult to produce rich sound quality without using a CPU capable of high performance. Therefore, a technology capable of guaranteeing a sound quality level good enough for a user to hear, while using less CPU resources is desired.

SUMMARY OF THE INVENTION

Accordingly, the present invention is directed to an apparatus and a method for processing MIDI that substantially obviate one or more problems due to limitations and disadvantages of the related art.

An object of the present invention is to provide an apparatus and a method for processing MIDI without significantly increasing a system load which may be caused by playback of the MIDI.

Another object of the present invention is to provide an apparatus and a method for processing MIDI to generate rich sound quality while using less CPU resources.

A further another object of the present invention is to provide an apparatus and a method for processing MIDI capable of reducing the amount of CPU resources used for frequency synthesis by controlling a volume of sound source samples before synthesizing the frequency.

A further another object of the present invention is to provide an apparatus and a method for processing MIDI capable of controlling a volume of a sound source sample using increments for the sound sample's volume and a volume summation.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an apparatus for processing MIDI includes: a MIDI parser for parsing a MIDI file to extract a plurality of notes, volume levels, volume section information, and note playback duration information from the inputted MIDI file; a MIDI sequencer for sorting and outputting the parsed notes in an order of playback duration; a wave table in which a plurality of sound source samples are recorded; a volume controller for controlling a volume of sound source samples that correspond to the notes using the volume sample number in each section in a volume section of the notes; and a frequency converter for converting the frequency of the volume-controlled sound source samples to a frequency assigned to the each note outputted from the MIDI sequencer and outputting the sound source samples.

In another aspect of the present invention, there is provided a method for processing MIDI, which includes: extracting a plurality of notes, volume levels, volume section information, and note playback duration information from an inputted MIDI file; calculating the volume sample number in each section using the extracted volume levels and the volume section information; controlling a volume of sound source samples using the calculated volume sample number in each section; and converting the frequency of the controlled sound source samples to a frequency assigned to the notes.

The present invention controls the volume of the sound source samples for MIDI to be played before performing frequency synthesis, thereby reducing a system load which may be caused by real time play of the MIDI.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Figure 3:
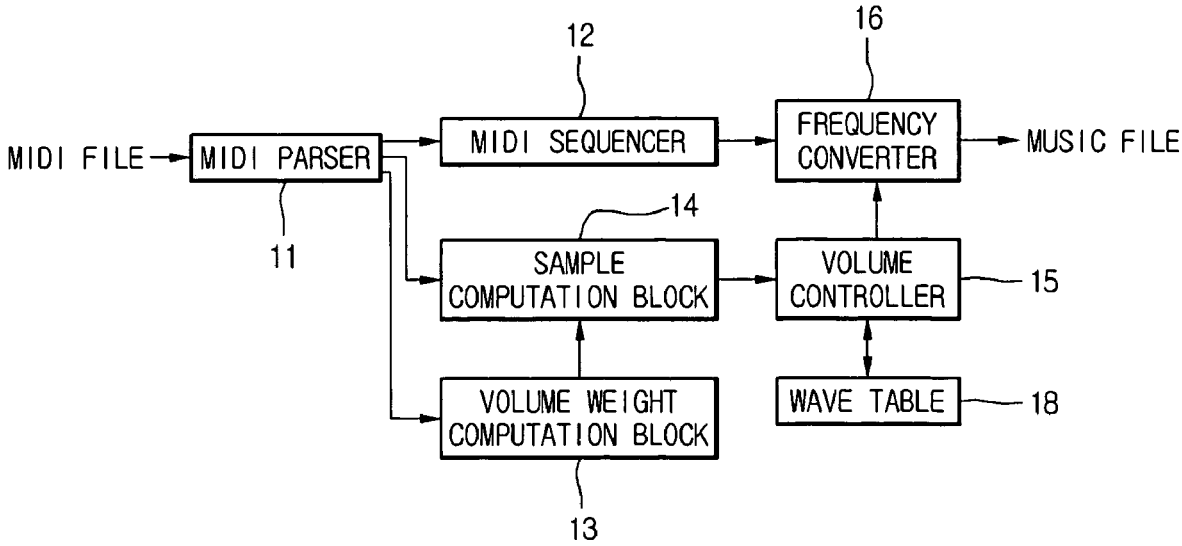
FIG. 3 is a block diagram of an apparatus for processing MIDI according to an embodiment of the present invention.

FIG. 3 is a schematic view illustrating a construction of an apparatus for processing MIDI according to a preferred embodiment of the present invention.

Referring to FIG. 3, the apparatus for processing the MIDI includes: a MIDI parser 11 for extracting a plurality of notes, volume levels, volume section information, and note playback duration information for the notes from a MIDI file; a MIDI sequencer 12 for sorting the note playback duration for the notes in the order of playback duration; a volume summation calculator 13 for calculating a volume summation for each section using the extracted volume level; a sample calculator 14 for calculating the volume sample number in each section using the volume summation in each section and the volume section information; a volume controller 15 for controlling a volume of sound source samples using the volume sample number in each section; a frequency converter 16 for converting the frequency of the controlled sound samples to a frequency assigned to the notes and outputting the sound source samples; and a wave table 18 in which the sound source samples are recorded.

The above-described apparatus for processing MIDI will be described in detail with reference to the accompanying drawings.

Referring to FIG. 3, the MIDI parser 11 parses the inputted MIDI file to extract a plurality of notes, volume levels, volume section information, and note playback duration information for the notes.

The MIDI file contains a MIDI-based tune having score data. The MIDI file is stored within a terminal or downloaded through a communication system. The ringtone for the wireless terminal is generally generated from a MIDI file except for a simple monotone sound. The MIDI file is structured to have numerous notes and control signals for the ringtone. Accordingly, for each ringtone, an instrument that corresponds to each note and additional data related to the instrument are analyzed from the sound source samples, and a sound is produced and played using the sound source samples.

The volume section information includes an attack section, a decay section, a sustain section, and a release section. Since the volume section information is represented differently according to the notes, the volume section information may be set such that it corresponds to each note.

Figure 1:
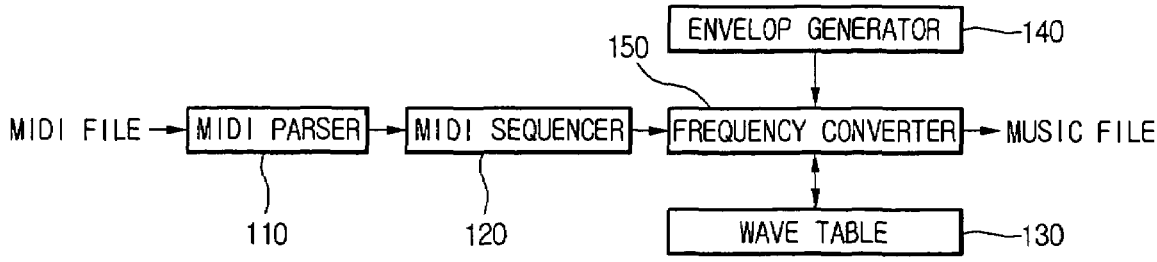
FIG.1(Related Art)
FIG. 1 is a block diagram of a MIDI player in related art.
Figure 2:
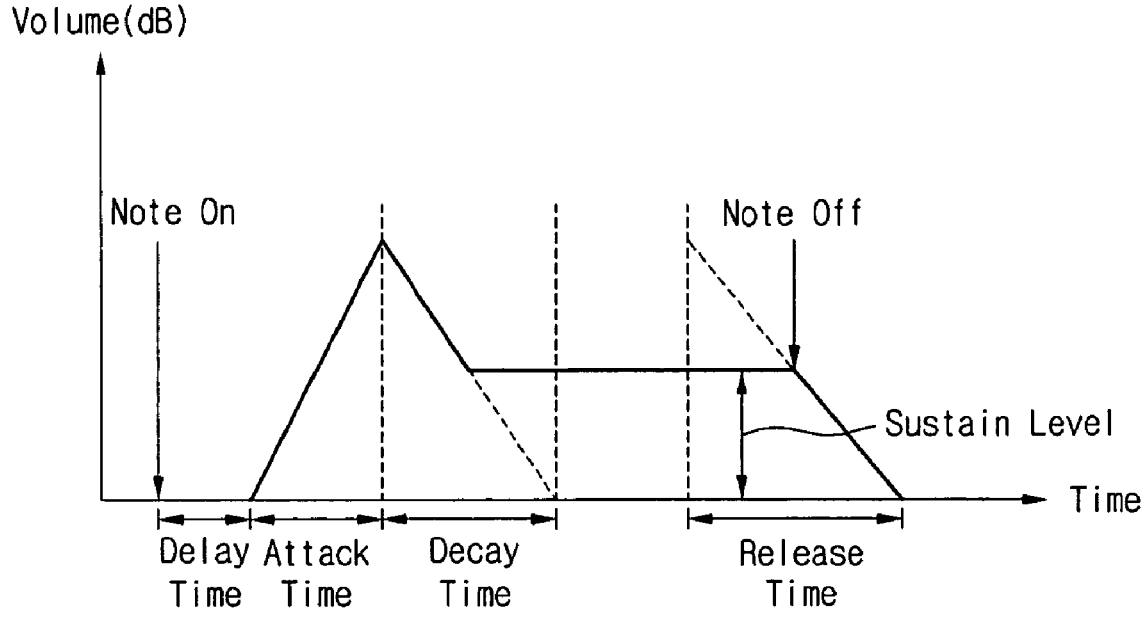
FIG. 2 is a view illustrating an envelope for a volume section of sound source samples.

Specifically, referring to FIG. 2, an envelope for the volume is classified into four sections of an attack, a decay, a sustain, and a release. A note can include an attack section during which the volume increases from zero to a maximum value for the note playback duration, a decay section during which the volume decreases from the maximum value to a predetermined volume, a sustain section during which the predetermined volume is sustained for a predetermined period of time, and a release section during which the volume decreases from the predetermined volume to zero and is released. The volume is converted to a natural sound through a volume control to produce an actual sound. For that purpose, the envelope for the volume is controlled. In the present invention, the envelope is not controlled by the frequency converter but controlled by a separate device.

Though the envelope is shown in a linear form, the envelope can be a linear form or a concave form depending on the kind of the envelope and characteristics of each step. Further, articulation data which is information representing unique characteristics of the sound source samples includes time point information corresponding to the four sections of an attack, a decay, a sustain, and a release, and is used in synthesizing a sound.

The MIDI file inputted to the MIDI parser 11 already contains information about certain music and is stored in a storage medium or downloaded in real time. The MIDI file may include a plurality of notes and note playback duration information. The note is information representing a sound. For example, the note represents musical scale information, such as 'C', 'D', and 'E'. Since the note is not an actual sound, the note should be produced from actual sound sources. Generally, the musical scale is in a range of 1 to 128.

Further, the MIDI file may be a musical piece having a beginning and an end. The musical piece may include numerous notes and lengths of each note. Therefore, the MIDI file may include information about the scale and the playback duration that correspond to the each note.

Further, a certain number of sound source samples may be pre-recorded in the wave table 18. The notes are produced from the sound source samples closest to an original sound.

Generally, since the number of the sound source samples recorded in the wave table 18 is limited and insufficient to produce all of the notes, the frequency of the sound source samples are converted to produce all of the notes.

Accordingly, the number of the sound source samples may be less than the number of the possible notes. That is, there are limitations in recording all of the 128 notes as the sound source samples in the wave table 18. Generally, only a representative number of sound source samples are selected out of the 128 notes and recorded in the wave table 18.

The MIDI file inputted to the MIDI parser 11 may include tens of notes or all of the 128 notes depending on a score. If the MIDI file is inputted, the MIDI parser 11 parses the MIDI file to extract a plurality of notes, volume levels, volume section information, and note playback duration information for the notes. Here, the note playback duration means a length of each note included in the MIDI file and is information about how long the note is played.

For example, if a playback duration of a note 'D' is ⅛ second, a sound source that corresponds to the note 'D' is played for ⅛ second.

At this point, the notes and the note playback duration are inputted to the MIDI sequencer 12. The MIDI sequencer sorts the notes in an order of the note playback duration. That is, the MIDI sequencer 12 sorts the notes according to the length of the duration for each track or the instrument.

The parsed volume levels are inputted to the volume summation calculator 13 and the volume section information is inputted to the sample calculator 14.

The volume summation calculator 13 divides the inputted volume level into a plurality of sections between zero and one, and applies the volume level for each section to the following equation 1 to calculate the volume summation level.

$$Wev=(1-V)/\log 10(1/V) \quad \text{[Equation 1]}$$

where Wev (weight of envelope) is the volume summation for each section and represents an envelope-applied time weight, and V represents the volume level for each section.

Therefore, the volume summation for each step can be outputted as many as the number of the sections divided from the volume level. For example, presuming that the volume level is divided into ten sections between zero and one, the volume level can be divided into a total of ten sections, including 0.1, 0.2, . . . , 1. At this point, the dividing of the volume level into a plurality of sections should be optimized. That is, as the volume level is divided into a greater number of sections (e.g., more than ten sections), the volume is generated in a more natural manner but the amount of CPU operation increases as well. On the contrary, as the volume level is divided into a lesser number of sections (e.g., less than ten sections), it becomes more difficult to generate a natural volume. Therefore, it is preferable to divide the volume level into optimized number of sections in consideration of the amount of CPU operation and the natural volume.

The volume summation for each section calculated by the volume summation calculator 13 is inputted to the sample calculator 14. The sample calculator 14 calculates the number of the volume samples using the volume summation for each section inputted from the volume summation calculator 13 and the volume section information inputted from the MIDI parser 11.

The sample calculator 14 determines a final time point for each volume section that will be applied in the volume section information using the volume summation for each section. The volume section information contains time points set for the respective sections currently determined, i.e., an attack section, a decay section, a sustain section, and a release section. The time points for the respective volume sections are newly determined by the volume summation for each section calculated so that the final time point for the respective volume sections are determined.

Further, the numbers of the volume samples for each section in the respective volume section where a final time point has been determined are calculated using the volume summation for each section. The number of the volume samples can be calculated by the following equation 2.

$$Sev=Wev/(SR*Wnote*Td) \quad \text{[Equation 2]}$$

where Sev (Sample of envelope) is the number of the volume samples for each section that corresponds to Wev, Sev is a notion obtained by converting a time of second unit into the number of the samples, Wev is a volume summation for each section, SR is a frequency of sound source samples, Wnote is a weight representing a difference between a frequency of sound source samples and a frequency assigned to the notes, and Td is a delay time when the volume level falls closely to zero.

That is, Sev is proportional to Wev and inversely proportional to SR, Wnote, and Td. The Sev is obtained by dividing the Wev by a product SR*Wnote*Td.

Therefore, the numbers of the volume samples for each section(Sev) in the respective volume section where the final time point has been determined are calculated using the equation 2. The calculated number of the volume samples corresponds to the number of the sections of the volume levels.

The number of the volume samples for each section (Sev) can be constructed in a form of a table as provided by the following equation 3.

$$Table[Nvol]=\{Sev1, Sev2, Sev3, \ldots, SevNvol\} \quad \text{[Equation 3]}$$

where Nvol represents the number of the sections of the volume level.

For example, presuming that the number of the sections of the volume level is ten, the table contains a total of ten volume samples. That is, the number of elements in the table is the same as the number of the sections of the volume.

The volume controller 15 controls a volume of the sound source samples using the number of the volume samples represented by the table.

Figure 4:
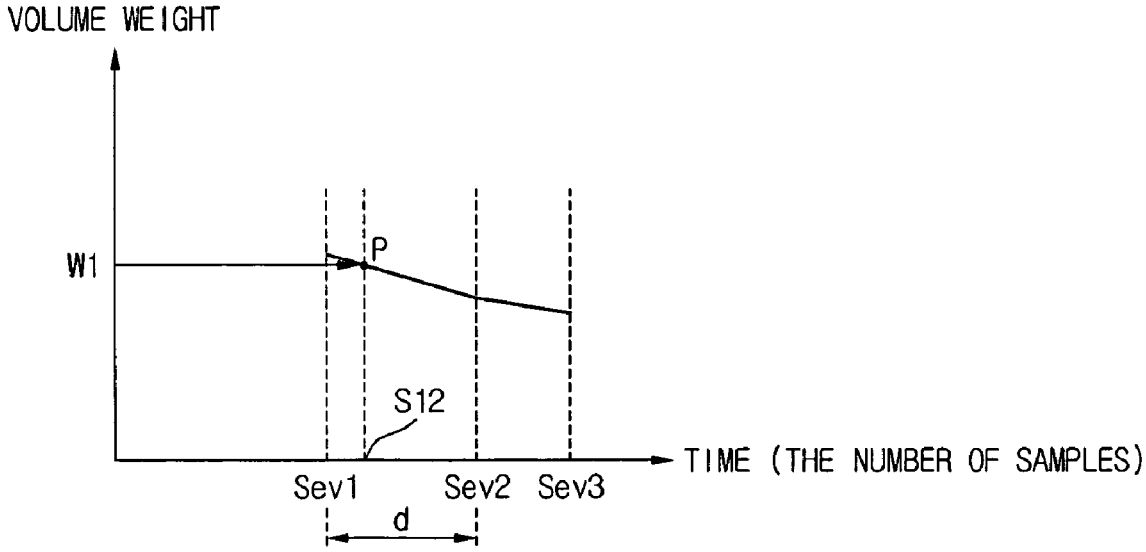
FIG. 4 is a view illustrating a method of controlling a volume of sound source samples in the apparatus illustrated in FIG. 3.

For example, referring to FIG. 4, if the envelope is to be applied to the volume of the sound source samples (d) between the number of first volume samples (Sev1) and the number of second volume samples (Sev2), the volume value of the sound source samples included between the number of the first volume samples (Sev1) and the number of the second volume samples (Sev2) is used to create a straight line having the number of the first volume samples (Sev1) and the number of the second volume samples (Sev2) at its ends, a point P on the straight line that corresponds to a sample S12 is multiplied by a weight W1. By doing so, the volume of the sound source samples can be easily controlled. Accordingly, a volume level between zero and one for each section is multiplied by a current volume that is to be applied to an actual sound, so that final volume levels that are to be multiplied by each sample are calculated in advance.

The MIDI sequencer 12 receives a plurality of notes and note playback duration information from the MIDI parser 11 and sequentially outputs the note playback duration for the notes to the frequency converter 16 after a predetermined period of time elapses.

The frequency converter 16 converts the frequency of the sound source samples whose volumes have been controlled by the volume controller 15 according to a frequency assigned to each of the notes outputted from the MIDI sequencer 12 and outputs a music file to the outside.

Though the examples have been explained on the assumption of one note, a volume value and volume section information for the note, and a note playback duration, the present invention can be applied in the same way to all of the notes included in the MIDI file in connection with the playing of the MIDI as discussed above.

Figure 5:
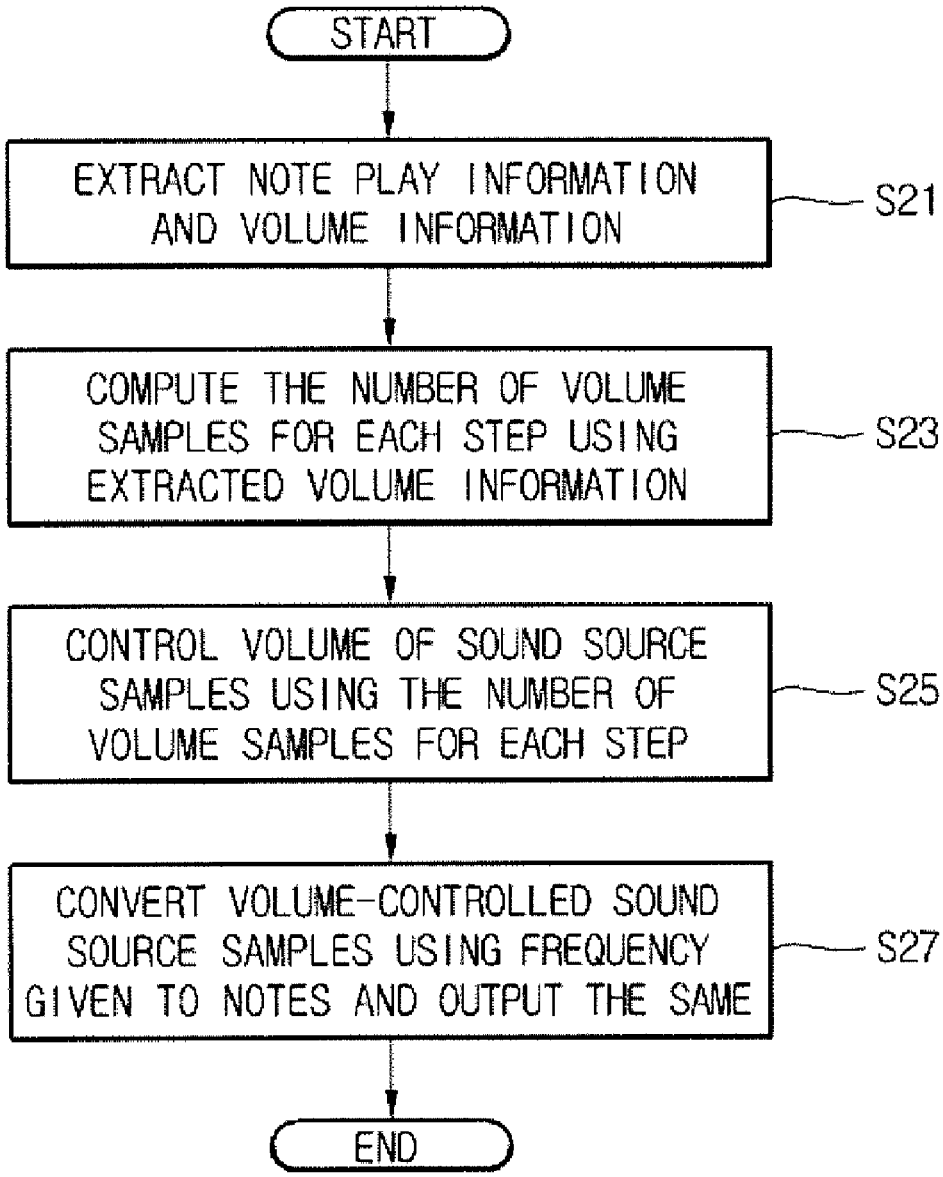
FIG. 5 is a flowchart illustrating a method for processing MIDI according to an embodiment of the present invention.

FIG. 5 is a flowchart illustrating a method for processing MIDI according to an embodiment of the present invention.

Referring to FIG. 5, note play information and volume information are extracted from the inputted MIDI file (S21). The note play information includes a plurality of notes and playback duration for the plurality of notes included in the MIDI file. The volume information includes a volume level of each note and the volume section information.

The number of volume samples for each section is then calculated using the extracted volume information (S23). For that purpose, the volume level included in the volume information is divided into optimized sections, and the volume summation for each section is then calculated. Further, the final time point for each volume section is newly determined using the volume summation for each section, and the number of volume samples for each section in the respective volume section is calculated.

Next, the volume of the sound source samples that correspond to the note play information is controlled using the number of volume samples for each section (S25). The frequency of the sound source samples whose volumes have been controlled are then converted to a frequency assigned to the notes and the sound source samples with the converted frequencies are outputted (S27).

As described above, according to the present invention, the frequency converter does not control the volume. Instead, the volume of the sound source samples is controlled in advance such that the volume may be appropriate for the respective notes, and the frequency converter converts the frequency of the sound source samples to output only the frequency of the sound source samples whose volumes have been controlled. In the related art, the operation gets congested and a CPU becomes overloaded when the frequency is converted and outputted in real time whenever loop data is repeated. The present invention can prevent the CPU overload and achieve more efficient and reliable processing of MIDI.

It will be apparent to those skilled in the art that various modifications and variations can be made in the present invention. Thus, it is intended that the present invention covers the modifications and variations of this invention provided they come within the scope of the appended claims and their equivalents.

What is claimed is:

1. An apparatus for processing MIDI (musical instrument digital interface) comprising:

a MIDI parser for parsing a MIDI file having a plurality of notes to extract the plurality of notes, corresponding volume levels, corresponding volume information comprising a plurality of volume sections, and corresponding note playback duration information from the MIDI file;

a MIDI sequencer for sorting and outputting the parsed plurality of notes according to the note playback duration information;

a wave table in which a plurality of sound source samples are recorded;

a sample calculator for calculating at least one sample number in each volume section using the volume information;

a volume controller for controlling a volume of sound source samples that correspond to the plurality of notes using the calculated at least one sample number; and a frequency converter for converting a frequency of the volume-controlled sound source samples to a frequency assigned to the each of the plurality of notes output from the MIDI sequencer and outputting the frequency-converted sound source samples to play a sound, wherein the sample calculator uses the volume information and a calculated summation of volumes for each volume section in order to calculate the at least one sample number.

2. The apparatus according to claim 1, further comprising a summation calculator that calculates the summation for each volume section by dividing each volume level into a plurality of volume levels and calculates a summation of volume levels in each volume section.

3. The apparatus according to claim 2, wherein the volume summation calculator divides each volume level into a plurality of volume levels in a range between zero and one.

4. The apparatus according to claim 2, wherein the summation for each volume section is an envelope-applied time weight.

5. The apparatus according to claim 2, wherein the number of sample numbers calculated by the sample calculator is same as the number of volume levels.

6. The apparatus according to claim 5, wherein the calculated at least one volume sample number in each volume section is proportional to the summation in each volume section and inversely proportional to a frequency of the corresponding sound source samples, a difference between the frequency of the corresponding sound source samples and a frequency assigned to the plurality of notes, and a time point at which the volume level decreases to zero.

7. The apparatus according to claim 1, wherein the volume information comprises an attack section, a decay section, a sustain section, and a release section.

8. The apparatus according to claim 1, wherein the sample calculator determines time points for each of the plurality of volume sections based on the calculated summation.

9. A method for processing MIDI (musical instrument digital interface) comprising:

extracting a plurality of notes, corresponding volume levels, corresponding volume information comprising a plurality of volume sections and corresponding note playback duration information from a MIDI file;

calculating a summation of volumes in each volume section using the extracted volume levels;

calculating at least one volume sample number in each volume section using the calculated summation;

controlling a volume of sound source samples corresponding to the plurality of notes using the calculated at least one calculated sample number in each volume section; and converting a frequency of the volume controlled sound source samples to a frequency assigned to the plurality of notes, wherein a final time point for each volume section of the volume information is determined using the calculated summation in each volume section.

10. The method according to claim 9, wherein the volume information comprises an attack section, a decay section, a sustain section, and a release section.

11. The method according to claim 10, wherein controlling of the volume of the sound source samples comprises:

selecting a volume level of the sound source samples which is between a first calculated sample number and a second sample number, and providing a summation of the volumes of sound source samples located at a point on a straight line having the first calculated sample number and the second calculated sample number as end points.

12. The method according to claim 9, wherein calculating the summation in each volume section comprises dividing each volume level into a plurality of volume levels having a certain range.

13. The method according to claim 12, wherein the certain range is between zero and one.

14. The method according to claim 12, wherein the number of calculated volume sample numbers is the same as the number of volume levels.

15. The method according to claim 9, wherein further comprising:

converting the calculated at least one volume sample number in each volume section to a table form containing the calculated at least one sample number in the each volume section; and controlling the volume of the sound source samples using the table.

16. The method according to claim 9, wherein the at least one volume sample number in each volume section (Sev) is calculated according to the equation $$Sev=Wev/(SR*Wnote*Td),$$

where Wev is a summation for each volume section, SR is a frequency of sound source samples, Wnote is a difference between a frequency of sound source samples and a frequency assigned to the plurality of notes, and Td is a delay time until the volume level decreases to zero.

* * * * *